US005729912A

United States Patent [19]

Gutkowski et al.

[11] Patent Number: 5,729,912

[45] Date of Patent: Mar. 24, 1998

[54] ARTICLE OF FOOTWEAR HAVING ADJUSTABLE WIDTH, FOOTFORM AND CUSHIONING

[75] Inventors: Lawrence J. Gutkowski, San Diego, Calif.; Kaia Michele Histand, Portland, Oreg.; Robert M. Lyden, Aloha, Oreg.; Ross A. McLaughlin, Lake Oswego, Oreg.; Daniel R. Potter, Forest Grove, Oreg.; John R. Robinson, Portland, Oreg.; Allen W. Van Noy, Beaverton, Oreg.

[73] Assignee: Nike, Inc., Beaverton, Oreg.

[21] Appl. No.: 480,921

[22] Filed: Jun. 7, 1995

[51] Int. Cl.[6] ..... A43B 3/26

[52] U.S. Cl. ..... 36/97; 36/93

[58] Field of Search ..... 36/97, 7.6, 93

[56] References Cited

U.S. PATENT DOCUMENTS

| | | | |
|---|---|---|---|
| 318,366 | 5/1885 | Fitch | 36/7.6 |
| 620,582 | 3/1899 | Goff | 36/7.6 |
| 641,642 | 1/1900 | Gunn . | |
| 1,182,787 | 5/1916 | Murphy | 36/7.6 |
| 1,539,762 | 5/1925 | Mussabini . | |
| 2,002,706 | 5/1935 | Mong | 36/7.6 |
| 2,112,052 | 3/1938 | Smith | 36/97 |
| 2,435,668 | 2/1948 | Behringer et al. . | |
| 2,497,175 | 2/1950 | Mantos | 36/97 |
| 2,579,953 | 12/1951 | Morris | 36/7.6 |
| 2,607,133 | 8/1952 | Marlowe . | |
| 3,251,144 | 5/1966 | Weitzner . | |
| 3,404,468 | 10/1968 | Rosen . | |
| 3,541,708 | 11/1970 | Rosen . | |
| 3,686,777 | 8/1972 | Rosen . | |
| 3,786,579 | 1/1974 | Clark et al. | 36/7.6 |
| 3,922,800 | 12/1975 | Miller et al. . | |
| 4,136,468 | 1/1979 | Munschy . | |
| 4,166,329 | 9/1979 | Herbig | 36/97 |
| 4,255,876 | 3/1981 | Johnson . | |
| 4,391,048 | 7/1983 | Lutz . | |
| 4,476,639 | 10/1984 | Zaccaria . | |
| 4,497,123 | 2/1985 | Ehrlich . | |
| 4,553,342 | 11/1985 | Derderian et al. . | |
| 4,592,154 | 6/1986 | Oatman . | |
| 4,598,487 | 7/1986 | Misevich . | |
| 4,599,811 | 7/1986 | Rousseau . | |
| 4,674,206 | 6/1987 | Lyden . | |
| 4,747,221 | 5/1988 | Hayes . | |
| 4,765,070 | 8/1988 | Chemello et al. . | |
| 4,794,674 | 1/1989 | Mintel et al. . | |
| 4,794,706 | 1/1989 | Puckhaber et al. . | |

(List continued on next page.)

FOREIGN PATENT DOCUMENTS

| | | |
|---|---|---|
| 1115950 | 1/1982 | Canada . |
| 443 293 | 8/1991 | European Pat. Off. . |
| 24 48 308 | 10/1980 | France . |
| 59 317 | 10/1891 | Germany . |
| 90/11698 | 10/1990 | WIPO . |

OTHER PUBLICATIONS

*Manuel of Shoemaking*, Second Ed., R.G. Miller, ed., Clarks Ltd. Printing Department, 1976, pp. 26–72.

*The Running Shoe Book*, Peter R. Cavanaugh, Anderson World Inc., 1980, pp. 186–212.

*The Complete Handbook of Athletic Footwear*, Malvyn P. Cheskin, Fairchild Publications, 1987, 99. 121–128.

*Primary Examiner*—Ted Kavanaugh

*Attorney, Agent, or Firm*—Banner & Witcoff

[57] ABSTRACT

An adjustment system for a shoe which permits independent adjustment of the width, footform and cushioning either between the lateral and medial sides of the shoe, or at different points along the longitudinal direction of the shoe. The present invention provides for the adjustment of the dimensions of a shoe in a plurality of discrete locations as between a nominal central point in the forefoot area of the sole and the medial and/or lateral aspects thereof. Adjustment would entail adjusting the width or girth in an associated area and the overall shape of the outline of the sole of a shoe. This is accomplished by providing a material variance in the midsole and various hardware configurations for adjusting the width of the midsole.

18 Claims, 14 Drawing Sheets

U.S. PATENT DOCUMENTS 4,813,157 3/1989 Boisvert et al. .
4,841,648 6/1989 Shaffer .
4,858,340 8/1989 Pasternak .
4,858,341 8/1989 Rosen .
4,860,464 8/1989 Misevich et al. .
4,897,938 2/1990 Davis .
4,944,099 7/1990 Davis .
4,956,927 9/1990 Misevich et al. .
4,967,492 11/1990 Rosen .
4,969,277 11/1990 Williams .
4,998,358 3/1991 Girardelli .
5,042,177 8/1991 Schoch .
5,060,402 10/1991 Rosen .
5,101,580 4/1992 Lyden .
5,113,599 5/1992 Cohen et al. .
5,123,181 6/1992 Rosen .
5,203,793 4/1993 Lyden .
5,241,762 9/1993 Rosen .
5,253,435 10/1993 Auger et al. .
5,257,470 11/1993 Auger et al. .
5,259,126 11/1993 Rosen .
5,285,584 2/1994 Dubner .
5,325,614 7/1994 Rosen .
5,329,704 7/1994 Martin, Jr. .
5,384,973 1/1995 Lyden .
5,404,658 4/1995 Rosen .

ARTICLE OF FOOTWEAR HAVING ADJUSTABLE WIDTH, FOOTFORM AND CUSHIONING

FIELD OF THE INVENTION

The present invention relates to articles of footwear having adjustable fit characteristics, and more particularly to articles of footwear which are readily and selectively adjustable by a user with respect to footform, width and cushioning.

BACKGROUND OF THE INVENTION

Many different approaches have been taken in the attempt to customize the footform, and in particular, the width provided by articles of footwear for an individual wearer. The prior art concerning fit and fit adjustment of footwear can generally be divided into four broad categories: (i) those utilizing inflatable bladder and pump systems to vary the amount of air or gas in areas of the shoe upper, (if) those utilizing insoles and insole systems to provide customized footform, (iii) those utilizing lacing or strap systems in conjunction with the shoe upper to fasten around the girth of the foot, and (iv) those utilizing various mechanical and/or elastic devices in the shoe.

It is generally recognized that significant anatomical differences exist between individuals having the same approximate foot length. Some of the parameters used in shoe making lasts to accommodate the variations are the ball, waist, instep, toe spring, toe thickness, heel height, bottom length, stick length, long and short heel measurements. Incorporating these parameters into shoe making represent an attempt to approximate desired fit characteristics for a substantial portion of a target population, i.e., the "average foot." In making shoe lasts, shoe length commonly changes by ⅓ inch per full size, and shoe width or girth will commonly change by ¼ inch per full size (American grades). Further, a change in width on the same size, i.e. length, last will also correspond to a difference of ¼ inch. Thus, a width change from A to D is the equivalent of a width or girth change of ¾ inches.

The *Manual of Shoemaking* published by Clarks Limited, 1976, pp. 27–73, which is hereby incorporated by reference, contains descriptions of feet, foot measurement and shoe lasts which are considered in shoemaking.

There are two general last types used to accommodate varying foot shapes: straight lasts and curved lasts. Shoes made on straight lasts generally feel more comfortable to wearers with relatively flat feet, while shoes made on curved lasts can feel more comfortable to wearers with high arches. Because of the shape differences, the fit of shoes of the same size which are made on straight and curved lasts will differ. More complete descriptions of the shaping and sizing of lasts are provided in *The Running Shoe Book*, Peter R. Cavenaugh, Anderson World, Inc., Mountain View, Calif., 1980, pp. 186–212; and *Athletic Footwear*, Melvyn P. Cheskin, Fairchild Publications, New York, 1987, pp. 121–128, which are both hereby incorporated by reference.

Because of the differences in shape between feet of the same size and width, even between the left and right feet of one person, manufacturing and stocking shoes incorporating a plurality of unique shape parameters is not economical. Although some of the prior art attempts to provide adjustable fit were successful in some respects, they include many shortcomings as well. Some of the prior art devices only provided a one time adjustment so that differences in a single wearer's feet could not be accommodated, for example, the expansion in width and/or girth over the course of a race or day. Many of the prior art attempts include complex mechanical devices incorporated in the sole of the shoe which may wear easily and fail in an athletic shoe environment in which the sole is subject to repeated forces which are magnified in running and jumping as opposed to walking. Furthermore, the prior art attempts to provide adjustment to the width and/or girth dimension generally provide for symmetrical adjustment both to the lateral and medial sides of the shoe, and to the forward or rearward areas of the forefoot. In other words, adjustment is assumed to be desired in proportionally equal amounts whether it is in the lateral and medial sides of the shoe, or in the forward or rearward areas of the forefoot.

There exists a need to provide a relatively simple adjustment system to provide width, footform and cushioning adjustment which can be adjusted repeatedly, and which provides for independent adjustment either between the lateral and medial sides of the shoe, or at different points along the longitudinal direction of the shoe.

SUMMARY OF THE INVENTION

Accordingly, it is an object of the present invention to provide an adjustment system for a shoe which permits independent adjustment of the width, footform and cushioning either between the lateral and medial sides of the shoe, or at different points along the longitudinal direction of the shoe. Broadly, the present invention provides for the adjustment of the dimensions of a shoe in a plurality of discrete locations as between a nominal central point in the forefoot area of the sole and the medial and/or lateral aspects thereof. Adjustment would entails adjusting the width and girth in an associated area and thus the overall shape of the shoe.

In a preferred embodiment of the invention, the adjustment system includes a sole assembly defining a periphery with lateral and medial aspects and defining a width and girth, thus the shape along the lasting margin of a shoe. The sole assembly includes a material variance in a midsole element to permit adjustment of the width, girth and shape along an outline of the sole which preferably corresponds to the lasting margin or side(s) of the shoe, and adjustment means for independently adjusting the width of the sole assembly in at least two different locations. The adjustment means comprises a plurality of threaded couplings affixed to the midsole element along the central axis and extending to adjustment locations along the periphery of the sole assembly. The threaded couplings are independently adjustable to adapt the shape of the shoe to the foot. The material variance refers to the configuration of the sole which allows for width adjustment, and may comprise any one of or a combination of the following: voids, softer compressible foam or foam members, gas filled bladders, flex joints or grooves which permit lateral to medial width adjustment.

In another preferred embodiment of the invention, the adjustment system includes a plurality of cords in one-to-one correspondence to the adjustment locations. Each cord is affixed to a midsole portion and extends to an adjustment location on the periphery of the midsole element. Each cord has a free end which is inserted into a wind-up device which winds and releases the cord so that adjustment of the cord causes compression or expansion of the midsole. The number of such cords and adjustment locations determines the number of points in the midsole at which independent adjustment can occur.

In yet another preferred embodiment of the invention, the adjustment system includes a plurality of planar ratchet devices also in one-to-one correspondence with the adjustment locations. The ratchet devices are attached to a midsole element with each ratchet device comprising a toothed surface in opposed relation to another surface having a pawl. The pawl surface is biased so that said pawl releasably engages the toothed surface, and adjustment of the ratchet device causes a change in the shape of the sole outline at that location. The number of ratchet devices determines the number of independently adjustable locations. This embodiment also may be used to allow for automatic adjustment of the forefoot area to enhance stability and support when the wearer's makes sharp movements such as cutting.

These and other features and advantages of the invention may be more completely understood from the following detailed description of the preferred embodiments of the invention with reference to the accompanying drawings.

DETAILED DESCRIPTION OF THE PREFERRED EMBODIMENTS

An athletic shoe incorporating the adjustment system of the present invention which is generally incorporated in the midsole of the shoe, and allows a wearer to customize the fit of the shoe repeatedly, accommodating many variables which effect the width or girth of the shoe particularly in the forefoot region. For purposes of illustration, the present application discusses the invention with regard to modem athletic footwear, but the concepts of the invention would be applicable in other kinds of footwear as well.

An athletic shoe has two main portions: the upper which surrounds a wearer's foot and the sole assembly. The sole assembly generally comprises an outsole which is the ground engaging outer surface, and a midsole disposed between the outsole and the upper to provide cushioning. The adjustment system of the present invention is incorporated into the sole assembly of an athletic shoe, and generally in conjunction with the midsole. The midsole has been known to be formed of a foamed polyurethane which may also include voids therein which include various cushioning elements.

In the present invention, the operation of the adjustment system involves providing a material variance in the midsole and providing means for moving the lateral or medial aspect of the midsole outward or inward with respect to a nominal center. The material variance can be accomplished by providing voids which can be molded in or providing cut-outs which involve a removal of foam material, by providing softer foam in the voids or in selected areas, or by providing gas filled bladder elements in the voids or in selected areas. The adjustment system comprises specially configured midsole elements which provide for independent adjustment of the width either between the lateral and medial sides of the shoe or at different points along the longitudinal direction of the shoe. The adjustment is most advantageously provided in the forefoot area as this is the portion of a foot which can vary greatly in width and shape for a given size. However, the adjustment can be provided at other locations in the shoe.

For clarity of illustration, the adjustment system of the present invention is shown in terms of the midsole portion of the shoe. Broadly, three preferred embodiments of the adjustment system are described herein: one which includes threaded elements, another which includes lace or cord elements, and a third which includes planar ratchet elements.

Figure 1:
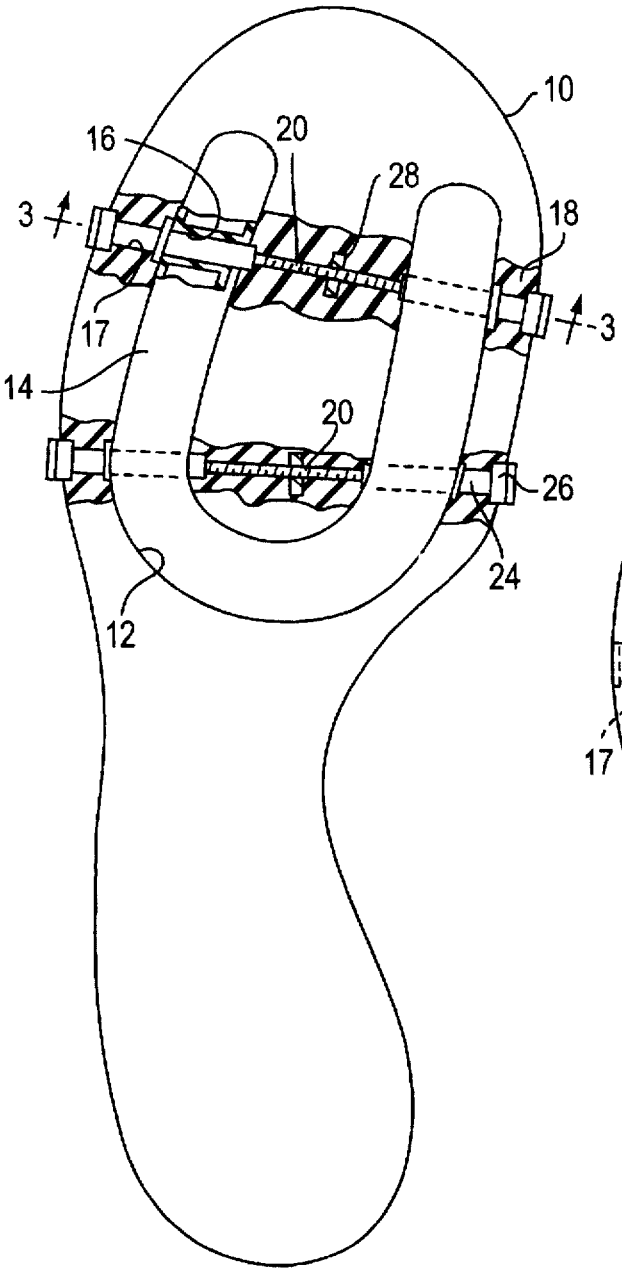
FIG. 1 is a top plan view, partially in section, of a shoe midsole element in accordance with a first preferred embodiment of the present invention.
Figure 2:
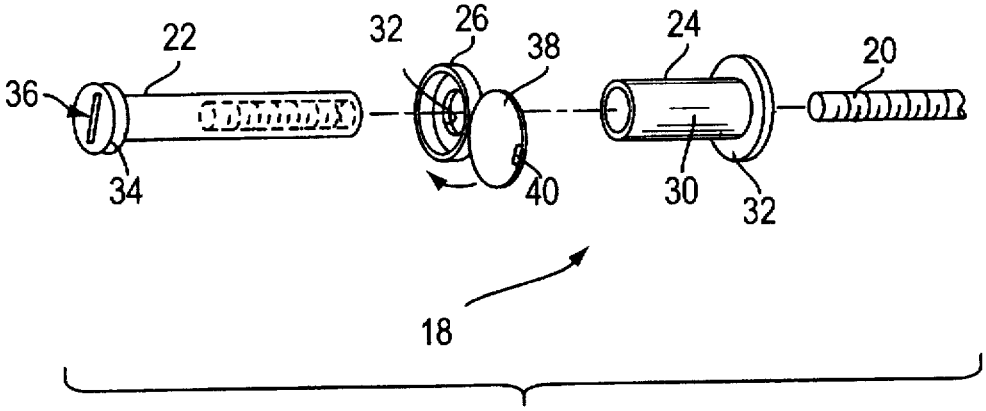
FIG. 2 is an exploded assembly view of a tightening mechanism of the midsole element of FIG. 1.
Figure 3:
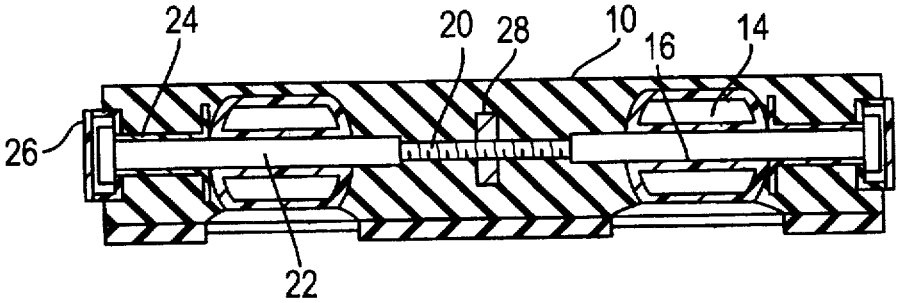
FIG. 3 is a cross section taken along line 3—3 of FIG. 1.

In a first preferred embodiment of the adjustment system shown in FIGS. 1–8, adjustment of the width of the forefoot area is accomplished by adjusting threaded couplings. Referring to FIGS. 1–3, midsole element 10 has a U-shaped void 12 which is shown with a gas filled bladder 14 located therein, and independently adjustable threaded couplings at four locations. Midsole element 10 is preferably formed of a foamed material such as polyurethane or ethylene vinyl acetate. Bladder 14 is preferably formed with suitable apertures 16 for cooperatively receiving threaded couplings 18, and corresponding apertures 17 are also provided in the foam of midsole element 10. Each threaded coupling 18 comprises an externally threaded rod 20, a mating internally threaded bolt 22, a bushing 24 and a cap 26.

Figure 7:
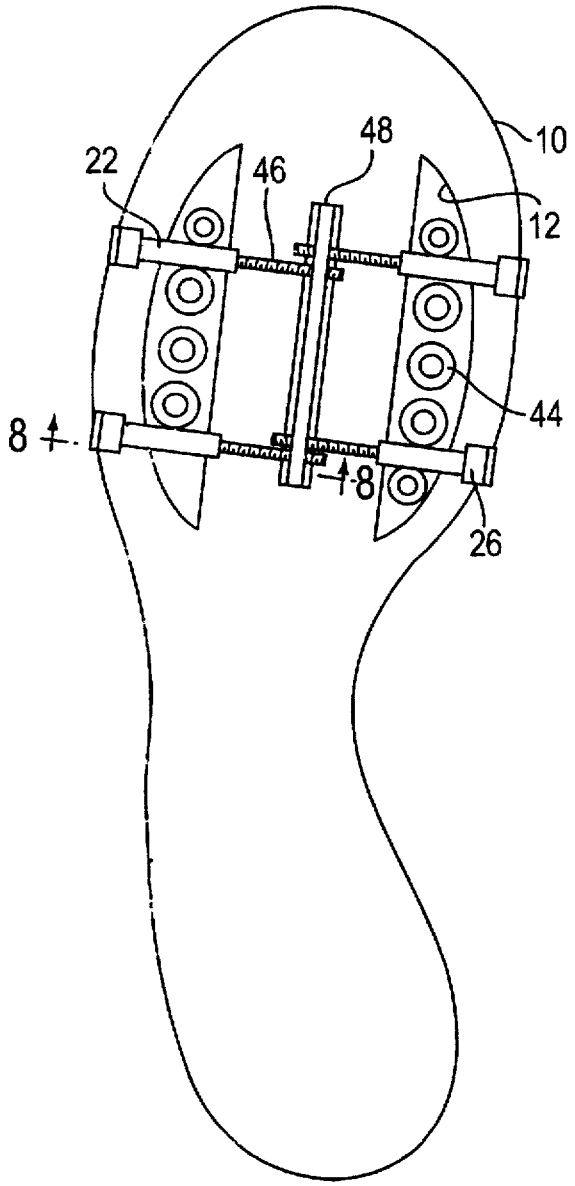
FIG. 7 is a top plan view of a fourth alternative configuration of the midsole element of FIG. 1.
Figure 8:
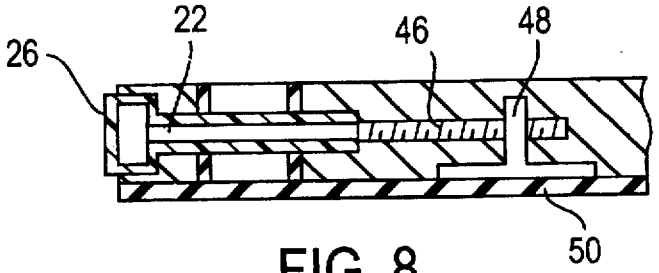
FIG. 8 is a cross section taken along line 8—8 of FIG. 7.

As seen in FIGS. 1–6, a single threaded rod 20 can extend across midsole element 10 and have a threaded coupling assembly 18 at each end. If a single rod 20 is used it must be fixed in midsole element 10 at a nominal central point by an anchor 28. Anchor 28 is illustrated as a block member but may be any suitable means for fixing the central point of a threaded rod 20 in the foam. Alternatively, separate rods may be used as seen in FIGS. 7 and 8 described below.

Referring to FIGS. 2–3, threaded rod 20 is matingly received in female threaded bolt 22, which itself is received in shaft portion 30 of bushing 24. The inside diameter of shaft portion 30 is dimensioned to receive bolt 22 with sufficient clearance for bolt 22 to be turned and adjusted on rod 20. Bushing 24 is received in foam aperture 17, and the side of bushing 24 closest to the central point includes a flange 32 which abuts against the side of foam aperture 17 adjacent void 12. Bolt 22 also passes through assembly aperture 32 of cap 26 so that when assembled, head 34 of bolt 22 rests within cap 26 so that head 34 is flush with the end of cap 26. Head 34 of bolt 22 includes a slot 36 which can be engaged with a suitable tool for turning bolt 22. Cap 26 includes a cover 38 which is hingedly connected thereto and closable to cover head 34. Cover 38 may have a notch 40 to facilitate opening and closing.

Therefore, when any of threaded couplings 18 are adjusted by turning respective bolt 22, the distance between the central point or anchor and the lateral or medial aspect of midsole element 10 will vary. In this manner, the width of the midsole element 10 can be adjusted. In FIG. 1, threaded couplings are provided at four different locations, and since rods 20 are fixed at their central points, each of the threaded couplings can be adjusted independently of another to provide maximum customization of width. An important feature of the invention is that adjustment of the medial and lateral aspects of midsole element 10 does not need to be symmetrical, but can be asymmetric with respect to the nominal central point.

Figure 4:
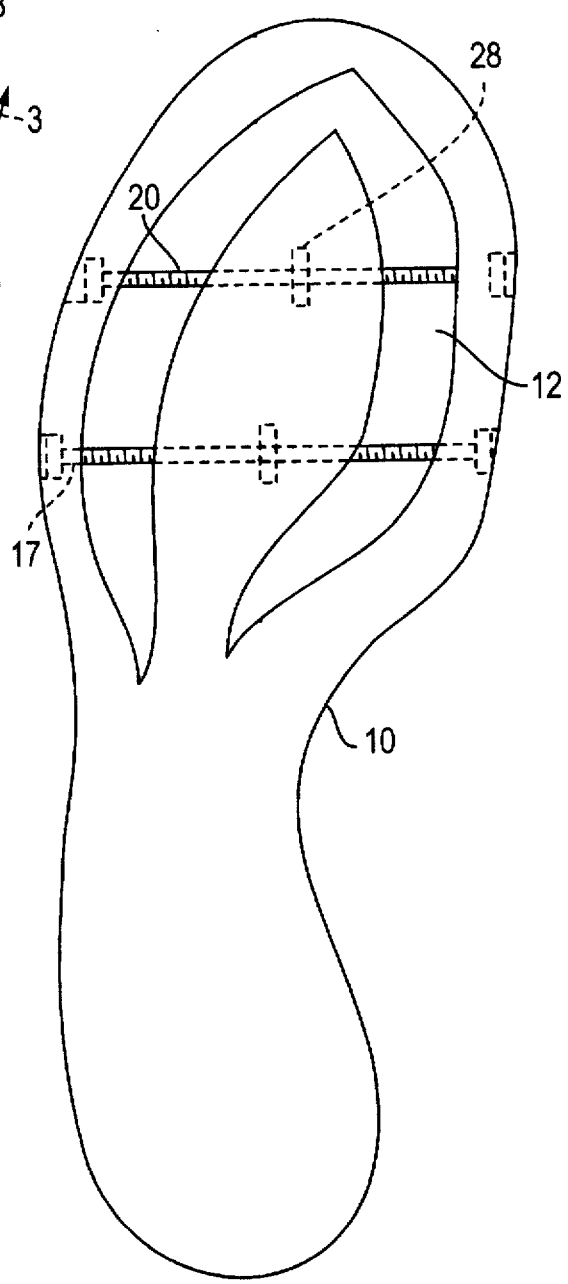
FIG. 4 is a top plan view of an alternative configuration of the midsole element of FIG. 1.

FIG. 4 illustrates an alternative construction of the midsole element of FIG. 1 in which void 12 has a curved and tapered shape. The construction of the threaded couplings is identical to that of the construction of FIG. 1. It is to be understood that void 12 could receive a gas filled bladder or softer foam or be left as a void.

Figure 5:
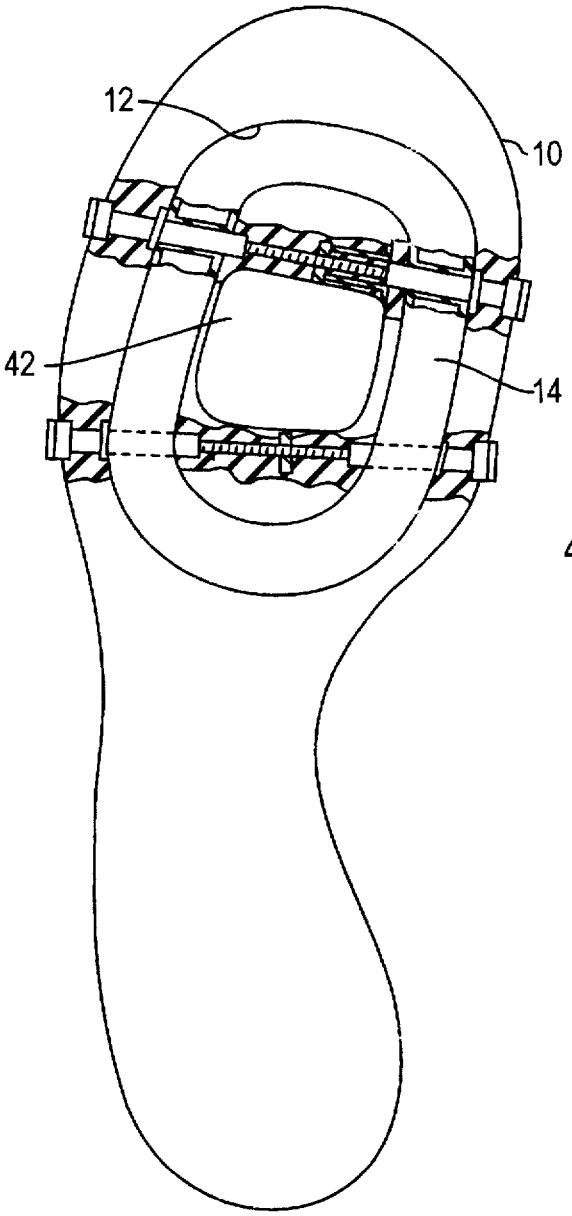
FIG. 5 is a top plan view, partially in section, of a second alternative configuration of the midsole element of FIG. 1.

FIG. 5 illustrates a second alternative construction of the midsole element of FIG. 1 in which void 12 has a generally toroidal shape and a similarly shaped gas filled bladder 14 is located therein. The threaded couplings are identical to those described with respect to FIG. 1. In this second alternative construction, another gas filled bladder 42 may also be used, in this instance in the central region of midsole element 10. The foam of midsole element 10 could be removed as appropriate to accommodate central bladder 42.

Figure 6:
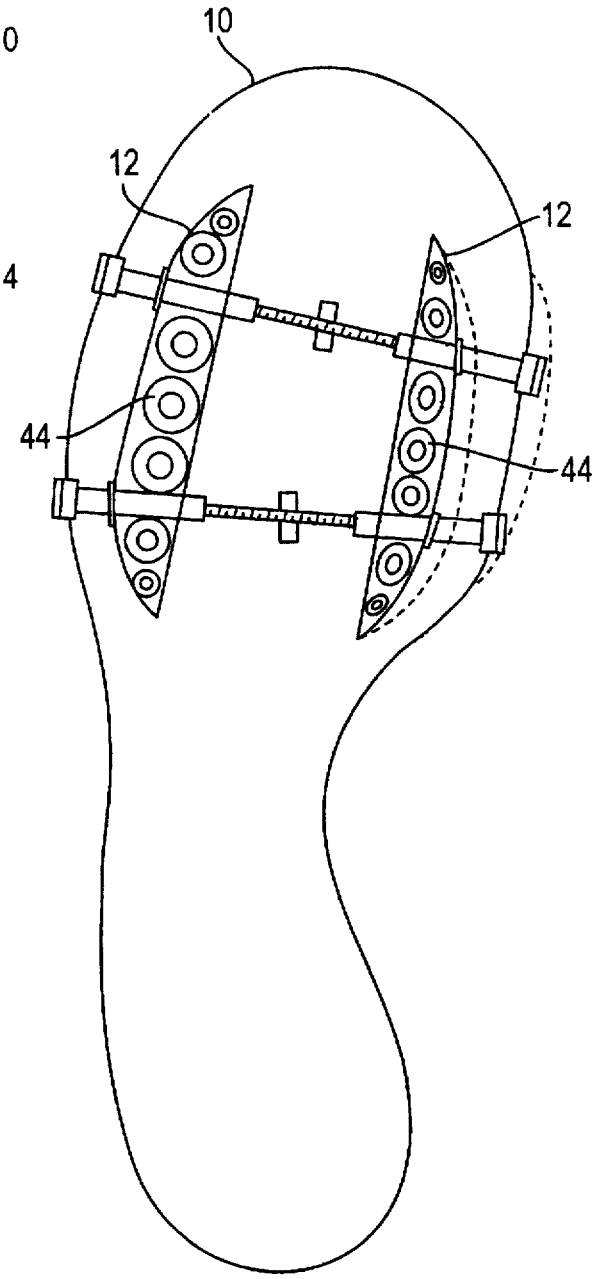
FIG. 6 is a top plan view of a third alternative configuration of the midsole element of FIG. 1.

A third alternative construction of the midsole element of FIG. 1 is illustrated in FIG. 6 in which voids 12 are fried with foam column members 44. Foam columns 44 are preferably tubular in cross section so as to facilitate compression. The threaded couplings are identical to those described with respect to FIG. 1, and the medial side of midsole element 10 (the right-hand side of the figure) has been adjusted so as to compress foam columns 44, i.e., the medial aspect of midsole element 10 is closer to the central point and anchor 28 so that foam columns 44 are shown deformed from their normally circular cross section. In addition, the dotted line represents the non-compressed outline of midsole element 10. Of course the two threaded couplings shown on the medial side are adjusted independently of one another.

Similar to the construction shown in FIG. 6, the midsole element illustrated in FIGS. 7 and 8 also uses tubular foam column members 44 in voids 12. Threaded couplings 18 of this construction are similar to those used in the previously described constructions except that bushing 24 is not required and shorter threaded rods 46 are used. Rods 46 are connected to a brace 48 which is disposed in the central portion of the midsole element, and brace 48 is attached to outsole 50 and serves generally the same function as central anchor 28 in the previous constructions. In FIG. 7 brace 48 is a relatively long member which extends longitudinally in the midsole element and is used as an anchor point for all of the threaded rods. Brace 48 is preferably made of a material such as a polyamide, a plastic material in the nylon family, which would allow flexion in the longitudinal direction. Of course individual braces may be used for each rod. This construction also provides for four discrete adjustment locations in the forefoot area.

Although tubular foam column members 44 are shown, it is to be understood that compressible foam members of any shape could be used in voids of any shape.

Figure 9:
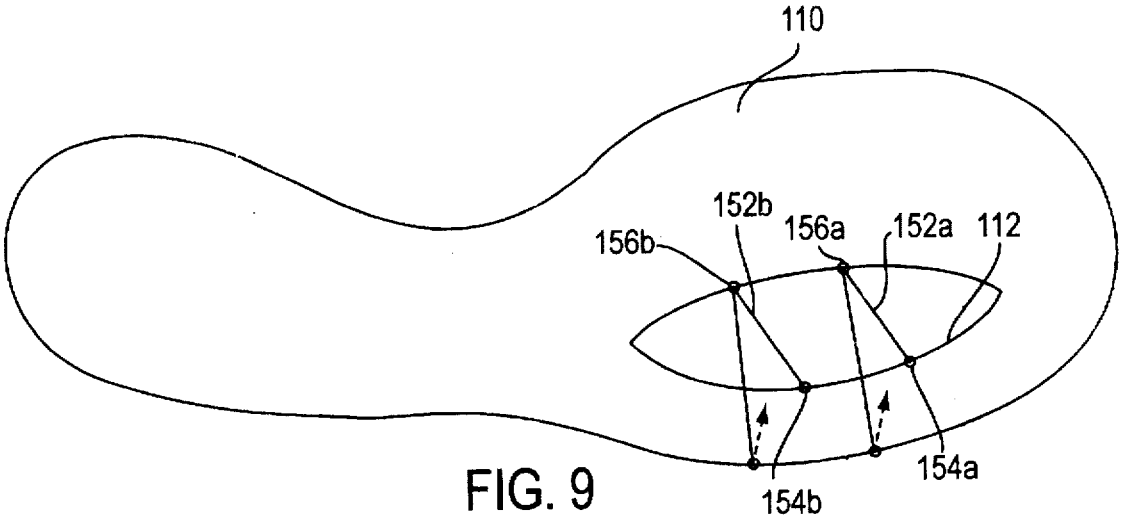
FIG. 9 is a top plan view of a shoe midsole element in accordance with a second preferred embodiment of the present invention.
Figure 10:
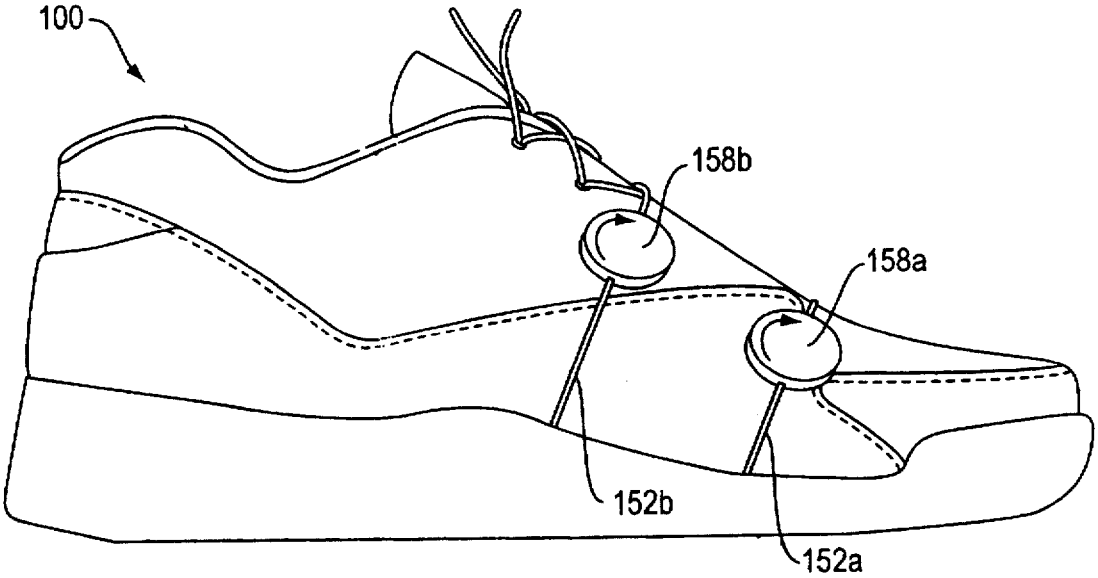
FIG. 10 is a side elevational view of a shoe incorporating the midsole element of FIG. 9.

In a second preferred embodiment of the adjustment system shown in FIGS. 9–12, adjustment of the width of the forefoot area is accomplished by adjusting laces or cords. Referring to FIGS. 9 and 10, midsole element 110 having void 112 on the lateral side thereof is illustrated, and the lateral side of an exemplary shoe upper 100 which may incorporate the adjustment system. A pair of cords **152*a* and 152*b* are shown affixed at corresponding anchor points 154*a* and 154*b*. Cords 152*a* and 152*b* extend across void 112 and around pins 156*a* and 156*b*, and then back across void 112, and then extend upward to the shoe upper. In FIG. 9 the upper ends of cords 152*a* and 152*b* are shown schematically to extend to shoe upper. Cords 152*a* and 152*b* are connected to wind-up devices 158*a* and 158*b*. Although wind-up devices 158*a* and 158*b* are shown attached to the side of shoe upper 100, they can be placed in a variety of locations such as on the side of the midsole. Examples of wind-up devices which can be used are disclosed in U.S. Pat. No. 5,042,177 to Schoch and assigned to Weinmann GmbH & Co. KG, and U.S. Pat. Nos. 5,117,567 and 5,117,882 assigned to Puma, Inc. In addition, instead of the wind-up devices, cords 152*a* and 152*b*** could be integrated into the lacing system of the shoe upper.

In operation, when the external portions of cords **152*a* and 152*b* are adjusted as by windup devices 158*a* and 158*b*, midsole element 110 is compressed or expanded by the movement of the cords in their pattern. For instance, if the cords are tightened, anchor points 154***a* and 154*b* would move closer to a nominal central point of the midsole element and cause a decrease in the width. Conversely, if the cords are loosened by the wind-up device, the foam of midsole element 110 would expand because of its inherent resilience and cause an increase in the width. Control of each wind-up device 158*a* and 158*b* is independent of the other thus providing two locations on the lateral side of the shoe which are independently adjustable. As with the other constructions, it is contemplated to be within the scope of the invention for void 112 to be filled with a compressible foam, compressible foam members or a gas filled bladder. In short, a material variance is provided in the midsole by the void alone or the different materials or elements incorporated into the midsole, all of which will permit width adjustment.

Figure 11:
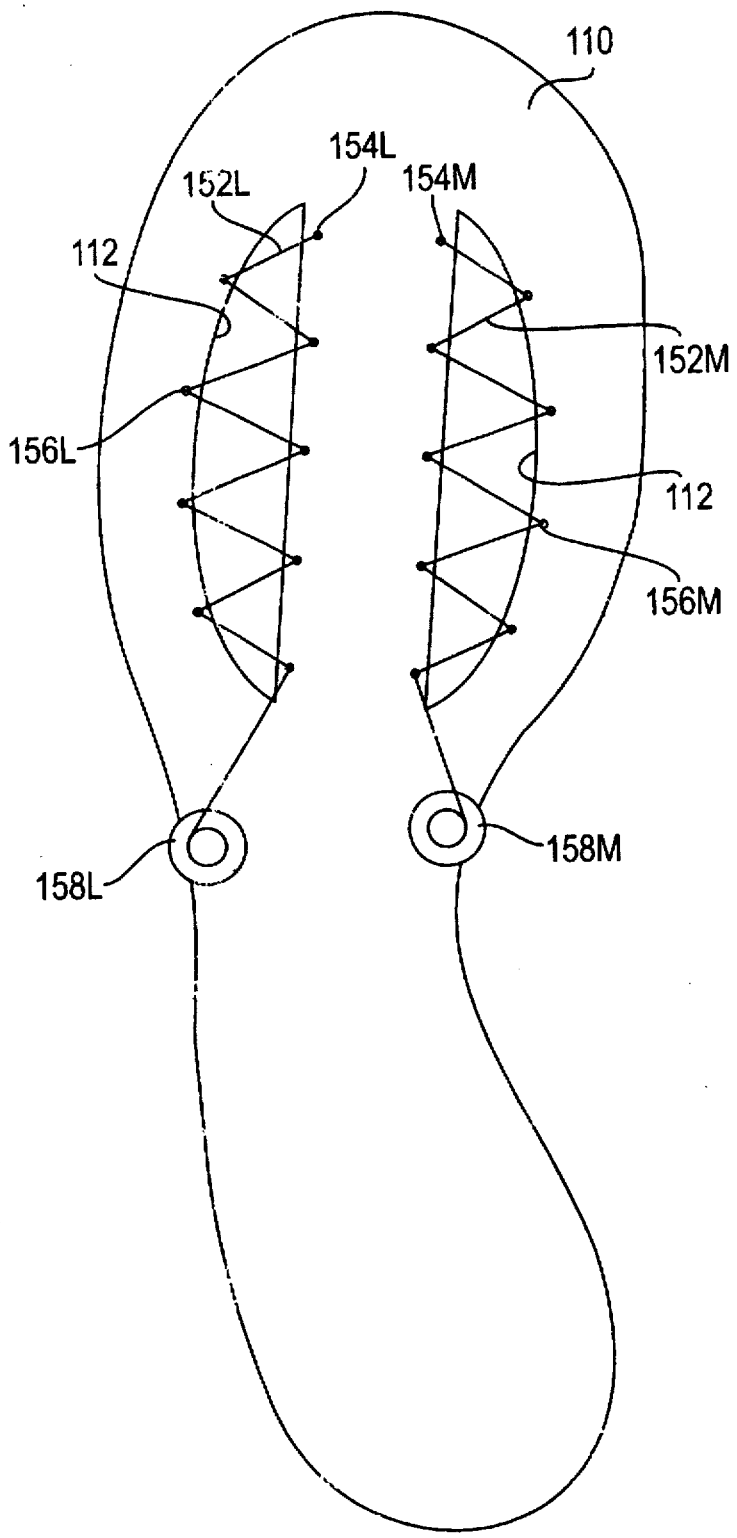
FIG. 11 is a top plan view of a first alternative configuration of the midsole element of FIG. 9.

FIG. 11 illustrates an alternative construction of the cord embodiment in which two voids 112 are arranged in the forefoot region of midsole element 110. Cords 152L and 152M extend along the lateral void and medial void respectively. Anchor points 154L and 154M are preferably located near the toe region, and a series of pins 156L and 156M are arranged along the edges of the voids. Alternatively, a series of eyelets could be used in place of the pins. Wind-up devices 158L and 158M are shown schematically for clarity of illustration, and may actually be located on the sides of the midsole or anywhere on the shoe upper. Control of wind-up devices 158L and 158M will provide independent adjustment of the lateral and medial sides of midsole element 110. As with the other constructions, voids 112 may be filled with compressible foam, compressible foam members or gas filled bladders, that is, provided with a material variance to permit movement of the lateral and media/aspects of the midsole element with respect to a nominal central point.

Figure 12:
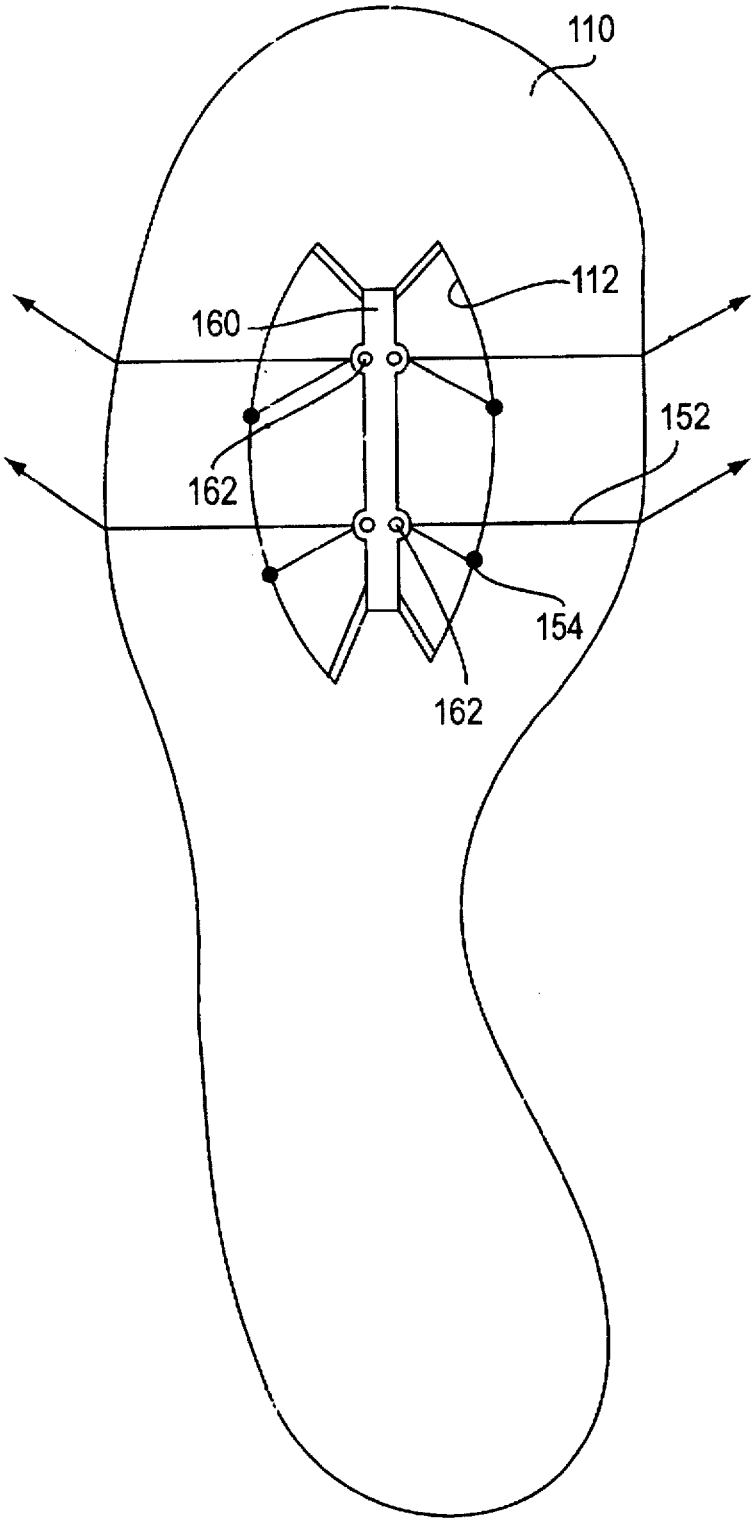
FIG. 12 is a top plan view of a second alternative configuration of the midsole element of FIG. 9.

FIG. 12 illustrates another alternative construction of the cord adjustment embodiment in which four independent adjustment locations are provided. Midsole element 110 includes a void 112 which is bisected by a brace piece 160. Brace piece 160 is firmly attached to the edges of void 112. Similar to the brace discussed above with respect to FIG. 7, brace piece 160 is made of a plastic material such as polyamide, which allows flexion in the longitudinal direction. Cords 152 are affixed to midsole element 110 at anchor points 154 at the outer lateral and medial edges of void 112. Cords 152 are laced through slide apertures 162 on brace piece 160 and then extended back toward the lateral and media/edges and to wind-up devices (not shown in FIG. 12). As with the previous constructions, wind-up devices may be placed on the sides of the midsole or attached to the shoe upper. As can be seen from FIG. 12, if any of the cords are tightened by its wind-up device, the cord is free to slide with respect to brace piece through the aperture, and the attachment point move closer to the nominal central point thereby decreasing the width of that region. The four cords shown in FIG. 12 are indicative of four locations of independent adjustment. Again, the voids provide the material variance that permits expansion and compression of the width of the midsole element.

Figure 13A:
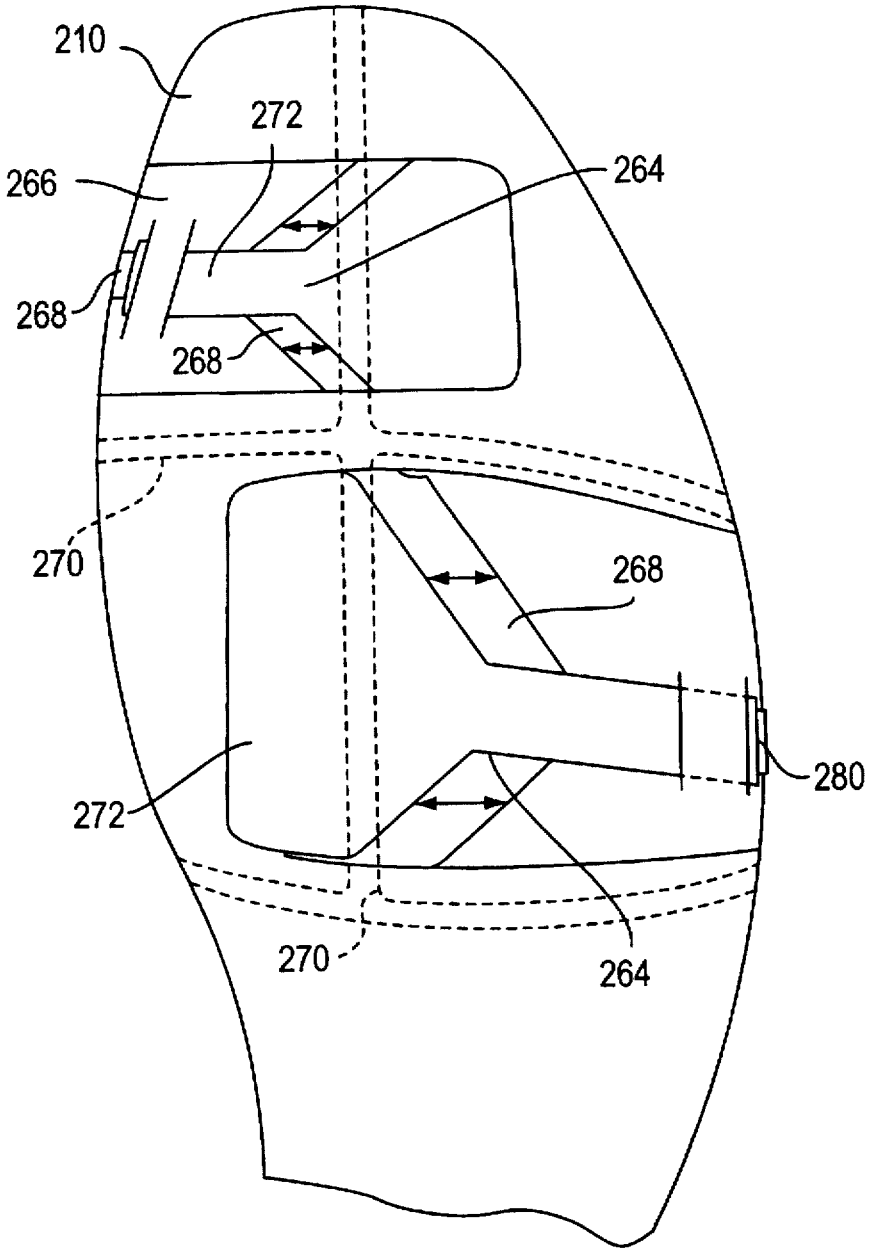
FIG. 13A is a top plan view of a shoe midsole similar to FIG. 13 but showing an alternative to the third preferred embodiment of the present invention.
Figure 13:
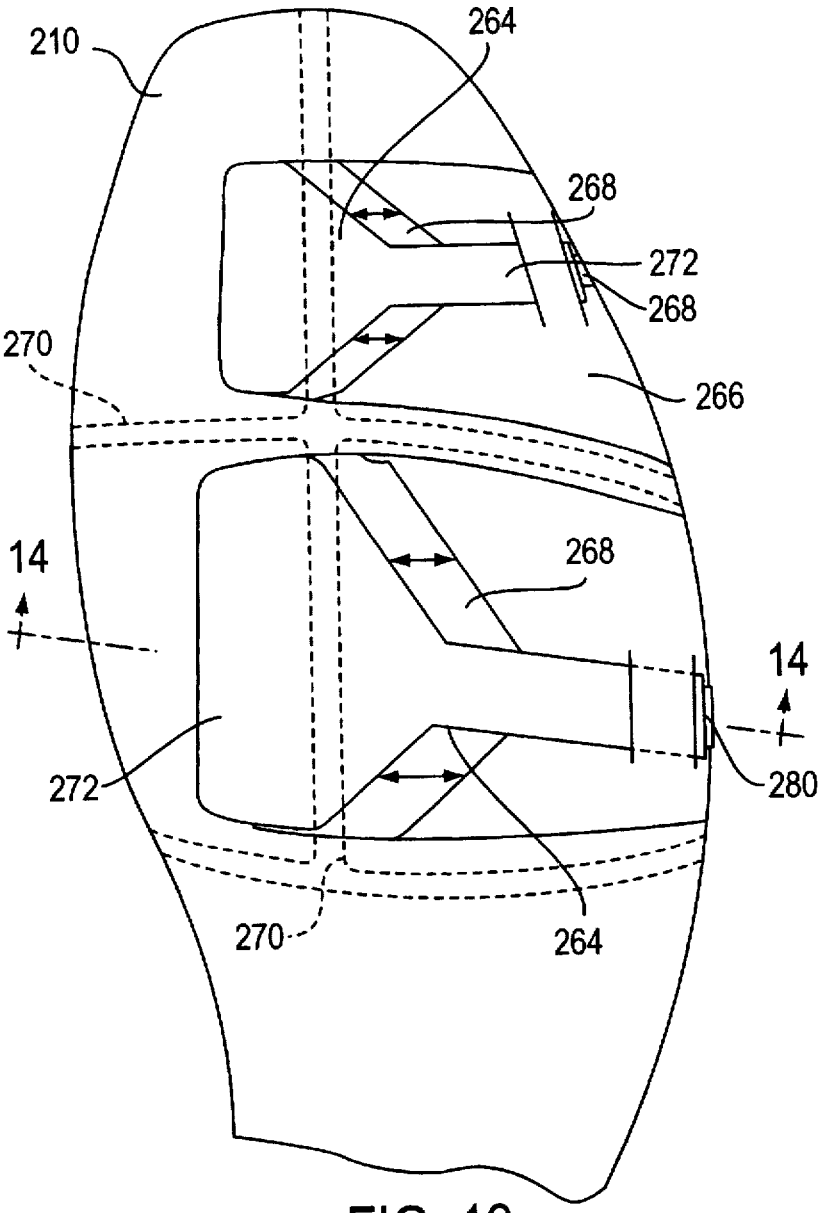
FIG. 13 is a top plan view of a shoe midsole element in accordance with a third preferred embodiment of the present invention.
Figure 14:
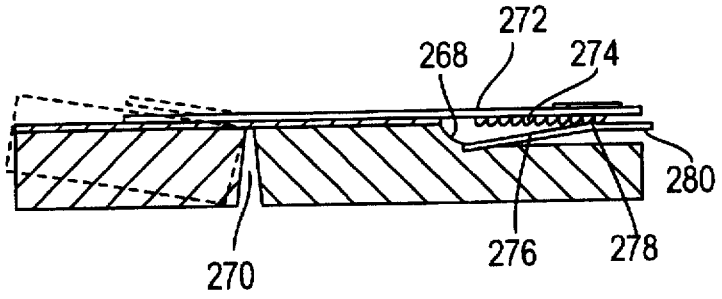
FIG. 14 is a cross section taken along line 14—14 of FIG. 13.

In a third preferred embodiment of the adjustment system shown in FIGS. 13–14, adjustment of the width of the forefoot area is accomplished by adjusting planar ratchet devices. Referring to FIG. 13, the top surface of midsole element 210 includes two planar ratchet devices 264 both affixed to the medial side of midsole element 210 and extending toward the lateral side of the midsole. A textile material 266 can be used to facilitate the sliding operation of ratchet devices 264. Midsole element 210 is provided with recessed areas 268 which provide the necessary clearance to permit free movement of planar ratchet devices 264. The two planar ratchet devices 264 may also be affixed to opposite sides of midsole element 210 as shown in FIG. 13A to allow for independent adjustment of the width from the opposing edges of the forefoot area. The broken lines represent flex joints 270 in the bottom portion of midsole element 210 and the outsole as seen in FIG. 14. U.S. Pat. No. 5,384,973 to Lyden entitled "Sole with Articulated Forefoot", the entirety of which is hereby incorporated by reference, describes such flex joints in the forefoot region of the sole.

Ratchet devices 264 are placed to cooperate with flex joints 270, and the flex joints provide the material variance which permits width adjustment of the forefoot region. Each ratchet device 264 comprises an upper member 272 with teeth 274 integrally provided on its bottom surface at the lateral side of the midsole. A lower member 276 is affixed to the midsole in recessed area 268 such that its proximate end is angled upward slightly. A pawl 278 is provided near the end for engaging teeth 274, and the end of lower member 276 also includes a release tab 280. The engagement of teeth 274 to pawl 278 is biased in the direction of reducing or narrowing the width of the forefoot region. Alternatively, lower member 276 may include teeth instead of a pawl so that the upper and lower teeth surfaces engage.

In operation, when the medial and/or lateral sides of the forefoot are articulated about the longitudinal axis, the rachet device can adjust the forefoot width in such a manner as to narrow the same. Thus, when a wearer suddenly changes direction, e.g. by making a cut, the article of footwear can narrow by action of the ratchet devices, thereby enhancing support and stability. This automatic adjustment has the effect of at least partially counteracting distentions of the materials of the shoe upper. The width can be manually varied by causing the opposing medial and lateral sides of the sole to be moved in closer proximity to one another.

As shown in broken lines in FIG. 14, when the ratchet device moves to narrow the midsole, the medial side of the midsole can be tilted slightly upward with respect to the flex joint to thereby reduce the effective width of the midsole while adjusting the foot supporting surface. The automatic adjustment occurs when the midsole is flexed, for example, by a wearer making a sudden lateral movement, flex joint 270 allow the midsole to articulate along an longitudinal axis and the ratchet devices move so that the lateral and medial edges of the midsole will be brought closer together. Release tab 280 can be pushed downward to release pawl 278 from engagement with teeth 274 and allow the midsole to expand. The construction shown in FIG. 13 permits for two locations of independent adjustment, both on the lateral side, but any number or arrangement of ratchet devices could be used in order to permit independent adjustment.

FIGS. 15–28 illustrate alternative constructions which provide the necessary material variance that permits independent width adjustment. In principle, any of these midsole elements could be used with any of the three preferred embodiments of the adjustment system described heretofore.

Figure 15:
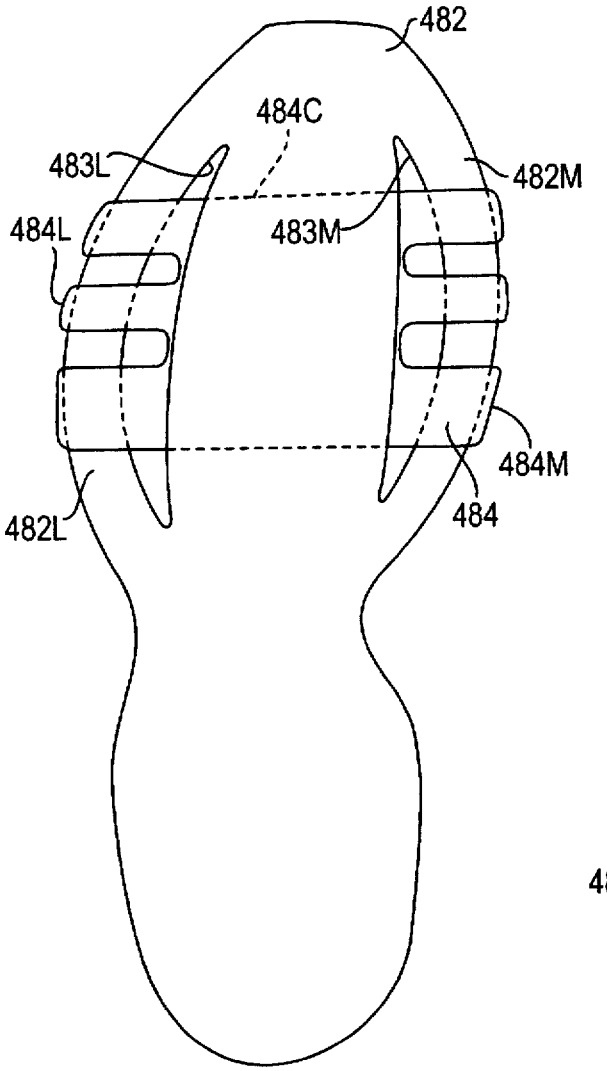
FIG. 15 is a top plan view of a shoe midsole element incorporating a bladder element to be used with any of the preferred embodiments of the present invention.

Midsole element 482 illustrated in FIG. 15 has voids 483 which incorporate a gas filled bladder member 484. Bladder 484 includes a central area 484C which may be inflated with a gas. Bladder 484 also includes lateral and media/side portions 484L and 484M which are inflated with gas. Central portion 484C of bladder 484 is positioned within the central portion of midsole element 482, and lateral and medial portions 484L and 484M extend through lateral and medial voids 483L and 483M respectively and extend to lateral and medial portions 482L and 482M of midsole element 482 respectively. Medial and lateral side portions 484M and 484L are preferably formed as tubular fingers that extend through holes in midsole portions 482M and 482L respectively. Central portion 484C of the bladder is affixed to the midsole element so that the bladder remains stationary when the midsole is adjusted so that lateral midsole portion 482L will move with respect to lateral bladder portion 484L by sliding over the tubular fingers, and medial midsole potion 482M will move with respect to medial bladder portion 484M by sliding over the tubular fingers. The resilience of midsole portions 482L and 482M would return them to their expanded positions when width adjustment is released. In other words, when the lateral and/or media/aspects of the midsole element are adjusted with respect to a nominal central point, the lateral and medial edges of the midsole element are able to move with freely in the area of the voids. The bladder may also compress or expand somewhat relative to the central point. In this manner, midsole element 482 is provided with a material variance which allows for inward and outward adjustment. This particular midsole element can be used in conjunction with any of the above-described adjustment systems: by providing molded-holes for threaded couplings, by arranging cords along the voids or by using with an articulated midsole and attaching planar ratchets to the top surface of the midsole.

Figure 16:
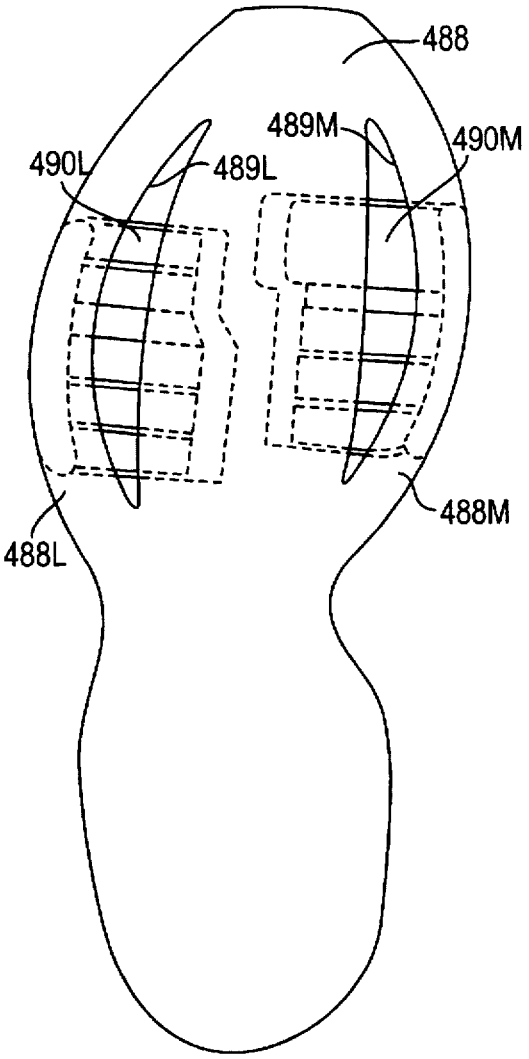
FIG. 16 is a top plan view of a second shoe midsole element incorporating a bladder element to be used with any of the preferred embodiments of the present invention.

Midsole element 488 shown in FIG. 16 is another variation having voids 489L and 489M, midsole portions 488L and 488M and corresponding gas filled bladder elements 490L and 490M which provide the material variance allowing for width adjustment. The lateral side includes bladder element 490L which is separate and distinct from bladder element 490M on the media/side. The portions of bladder elements 490L and 490M which are positioned within midsole portions 488L and 488M respectively, are affixed there by adhesives or other known means with the ends of the bladder elements may be visible from the sides of the midsole, e.g., through windows. The potions of bladder elements 490L and 490M which extend through voids 489L and 489M respectively and into the central portion of midsole element 488 are free to move relative to the midsole material. Therefore, when used in conjunction with an adjustment system, the lateral and medial aspects of the midsole element can move inward or outward with their respective bladder elements moving together due to the connection at outer midsole portions 488L and 488M to thereby provide width adjustment.

Figure 17:
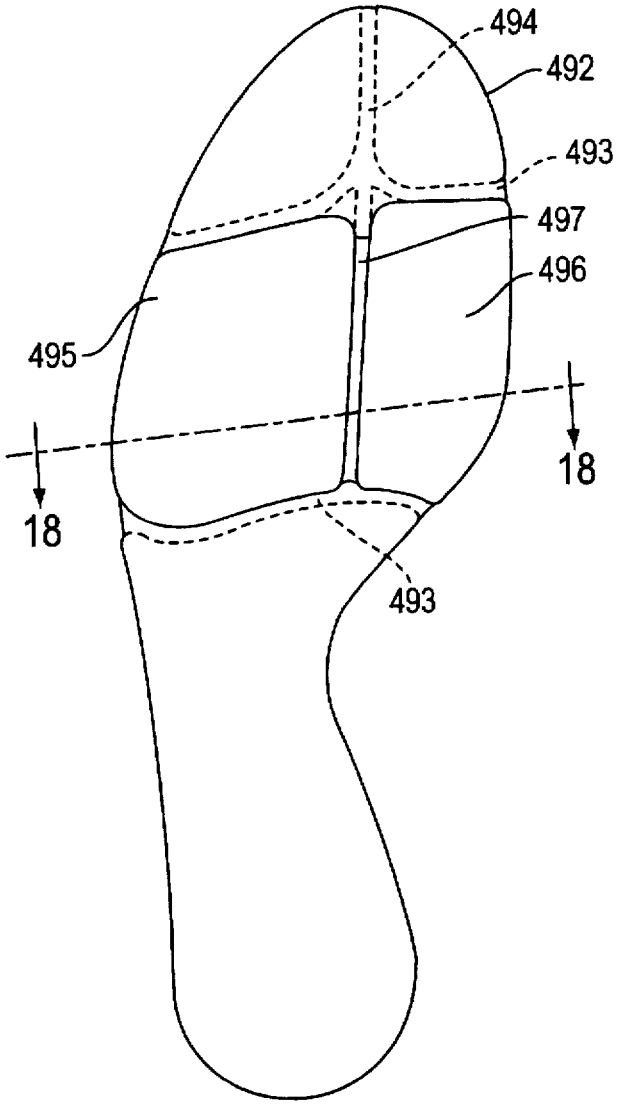
FIG. 17 is a top plan view of a third shoe midsole element incorporating a bladder element to be used with any of the preferred embodiments of the present invention.
Figure 18:
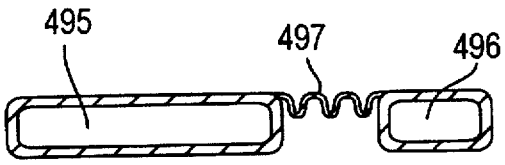
FIG. 18 is a cross section taken along line 18—18 of FIG. 17.

Midsole element 492 shown in FIGS. 17 and 18 is a construction which can be used in conjunction with the articulated sole pattern which includes arched transverse grooves 493, like those disclosed in U.S. Pat. No. 5,284,973 to Lyden mentioned above. These grooves 493 are intended to accommodate articulation of the phalanges, and phalanges-metatarsal joints. In addition, a groove 494 extends from the area approximately between the first and second metatarsals in the area rearward of the metatarsal heads in an anterior direction between the phalanges of the hallucus longus (big toe) and the second toe of a wearer's foot. Longitudinal groove 494 accommodates greater independent movement of the big toe and medial aspect of the midfoot and forefoot relative to the lateral aspect and vice-versa.

Figure 19:
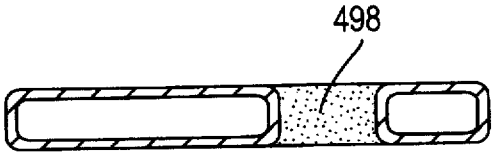
FIG. 19 is a cross section similar to FIG. 18 showing an alternative configuration.

One way of providing the necessary material variance to midsole element 492 which includes the articulation features, is to use a side-by-side gas filled bladder configuration as shown in FIGS. 17–19. In FIGS. 17 and 18, lateral bladder portion 495 and medial bladder portion 496 are connected by a bridge film 497 which extends in the area of the longitudinal flex groove. In the cross section, FIG. 18, bladder portions 495 and 496 are shown slightly compressed together which causes bridge film 497 to flex. The width of bridge film 497 determines the maximum extent of separation of bladder portions 495 and 496, and therefore the maximum width of the footform. FIG. 19 is a cross section of a slight variation on the construction of FIGS. 17 and 18. In place of bridge film 497, a compressible foam member 498 is used between the lateral and medial bladder portions. The necessary material variance is provided to the midsole in these ways. Any of the adjustment systems disclosed herein could employ these bladder configurations such as by providing molded in holes in the bladders to receive threaded couplings as shown in the bladder in FIG. 1.

Figure 20:
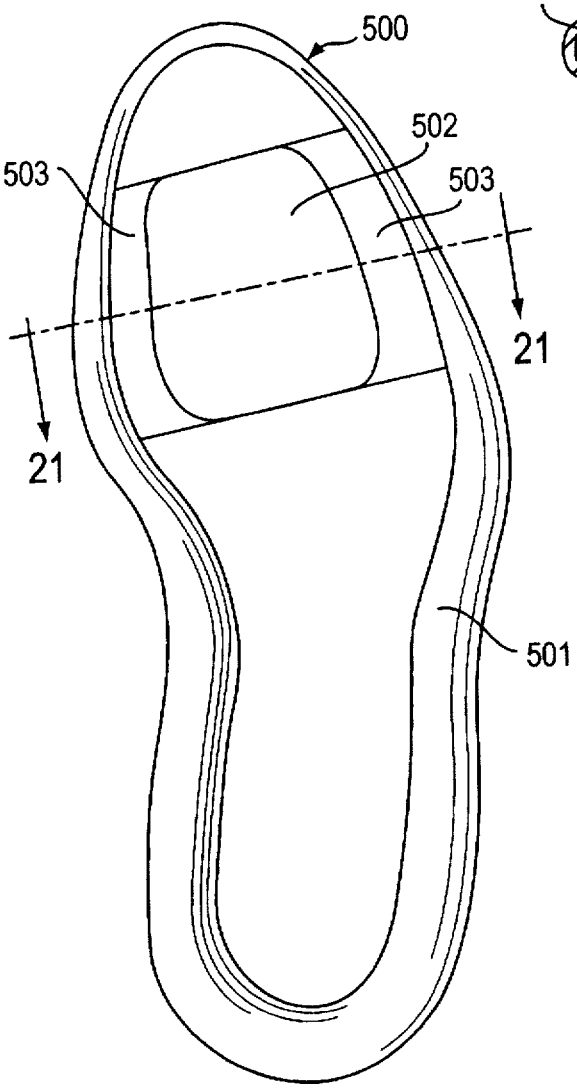
FIG. 20 is a top plan view of a fourth shoe midsole element incorporating bladder elements to be used with any of the preferred embodiments of the present invention.
Figure 21:
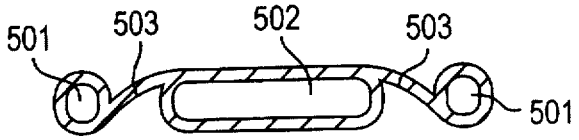
FIG. 21 is a cross section taken along line 21—21 of FIG. 20.
Figure 22:
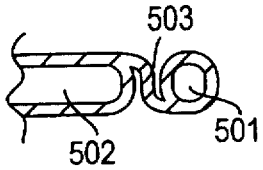
FIG. 22 is a portion of the cross section of FIG. 21 shown in the compressed state.

Yet another bladder configuration is shown in FIGS. 20–22 which illustrates a midsole element 500 having a peripherally-disposed cushioning bladder 501 and can then be described as a tangential weld pattern. The forefoot region of the midsole is constructed with a central bladder 502 connected to the peripheral bladder 501 by a bridge film 503 on either side. The configuration of bridge film 503 between peripheral bladder 501 and central bladder 502 is shown in cross section in FIGS. 21 and 22. Bridge film 503 is welded near or at the top surface of central bladder 502 and near or at the bottom of peripheral bladder 501. The reason for this can be seen in FIG. 22 which shows one side of the bladder configuration in a compressed state: the way that bridge film 503 links the two bladders provides it with a natural fold pattern when the midsole is compressed. As with the previous constructions, this particular bladder configuration provides the necessary material variance to permit width and footform adjustment. Any of the preferred adjustment systems may employ this bladder configuration. Although for illustration purposes a simple pillow-like central bladder is shown, the invention is in no way limited to such. Any type of bladder may be used for the central one since as long as the bridge films provide the requisite flexibility to compression and expansion.

Figure 23:
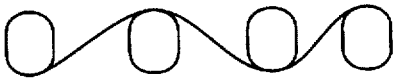
FIG. 23 is a cross section similar to FIG. 21 showing an alternative configuration.
Figure 24:
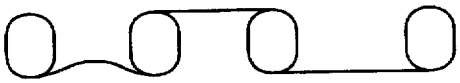
FIG. 24 is a cross section similar to FIG. 23 showing still another alternative configuration.

FIGS. 23 and 24 illustrate schematically two different cross sections for bladder arrangements. The outermost circles represent the cross section of a peripheral bladder like that shown in FIG. 20, and the innermost circles represent central bladders or bladder portions which are tubular. The lines linking the circles represent bridge films which are all tangentially welded to the bladders/bladder portions. FIG. 23 shows an alternating tangential weld pattern and FIG. 24 shows a parallel tangential weld pattern. As can be seen in the figures, the weld patterns are intended to provide various compression fold patterns. Of course any of the preferred adjustment systems can employ such bladder configurations.

Figure 25:
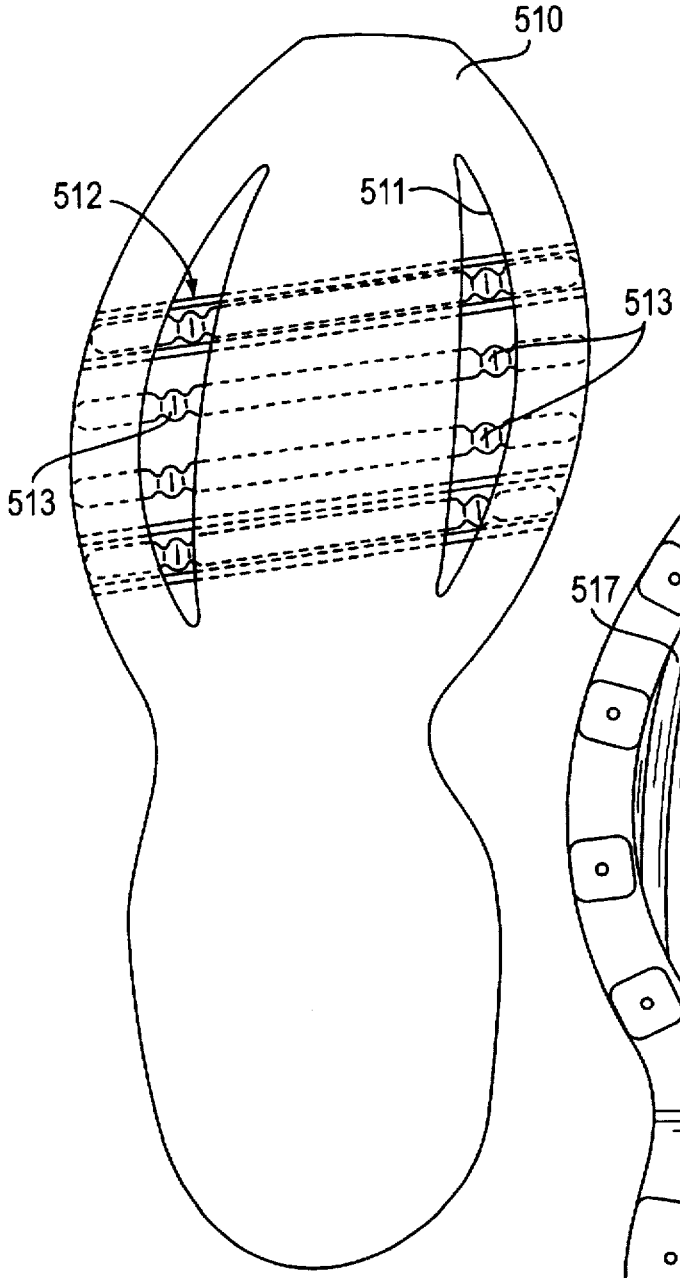
FIG. 25 is a top plan view of a fifth shoe midsole element incorporating bladder elements to be used with any of the preferred embodiments of the present invention.

Still another bladder configuration is shown in FIG. 25 in which a midsole element 510 has voids 511 and a bladder 512 positioned in the midsole. Bladder 512 comprises tubular members which include pleated sections 513 in the area of the voids in order to permit compression or expansion. Since the pleated sections of the bladder provide the requisite freedom of lateral movement, the portions of the bladder which are positioned with in the midsole are affixed so that there is no movement of any part of the bladder within or relative to the midsole. Rather the pleated sections in combination with the voids provide the necessary material variance that permits width adjustment. Of course any of the preferred adjustment systems may employ this constructions.

In all of the adjustable width embodiments, an adjustment to the width entails an adjustment to the footform, which is the foot supporting surface of a shoe. In addition, width adjustment as accomplished in the present invention, that is, by providing a material variance in the midsole, also influences the cushioning effects of the midsole. This is particularly true in those constructions which employ bladders. It can be readily understood that a change in the shape of a bladder by lateral compression or expansion will affect its inner volume, internal pressure, and exhibited stiffness in compression, thus its cushioning characteristics. Therefore, in addition to adjusting for fit, the adjustment system of the present invention can provide, e.g., the advantages of increased stiffness in compression, stability and more suitable cushioning for a wearer having a narrower foot and thus smaller weight-bearing area.

Figure 26:
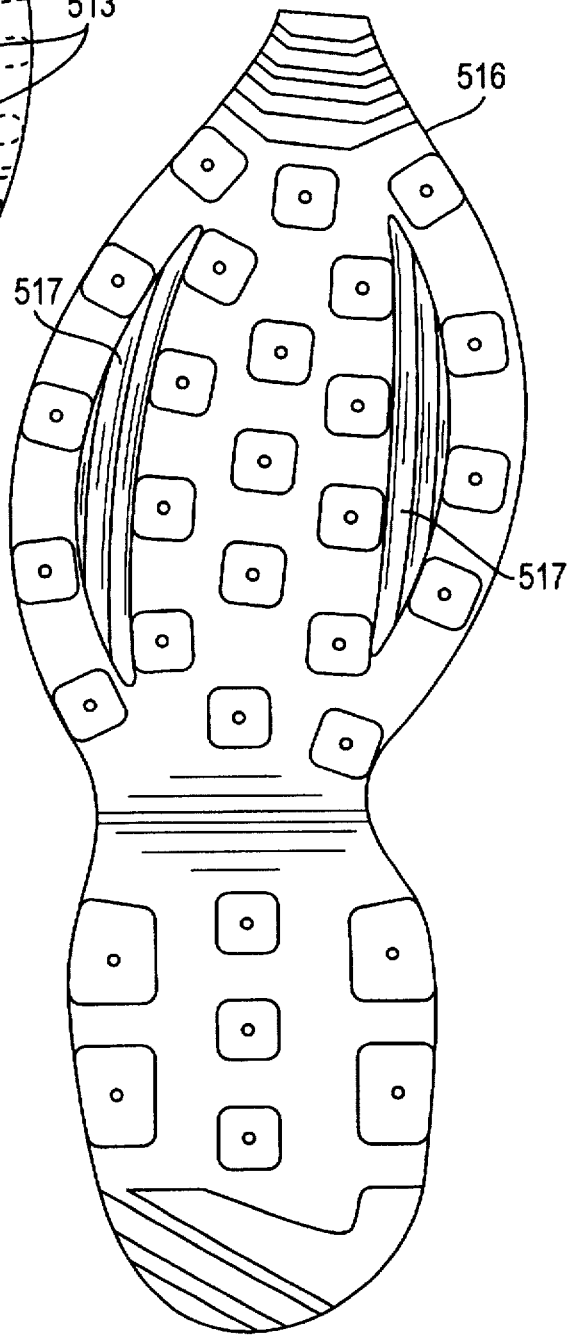
FIG. 26 is a bottom plan view of an outsole to be used with any of the preferred embodiments of the present invention.

FIG. 26 is a bottom plan view of an exemplary outsole 516 having pleats 517 which preferably correspond to the location of the midsole that requires movement, such as the area of the voids in many of the constructions discussed herein. The pleats may be located in any area of the outsole which would most advantageously serve to permit width adjustment.

Figure 27:
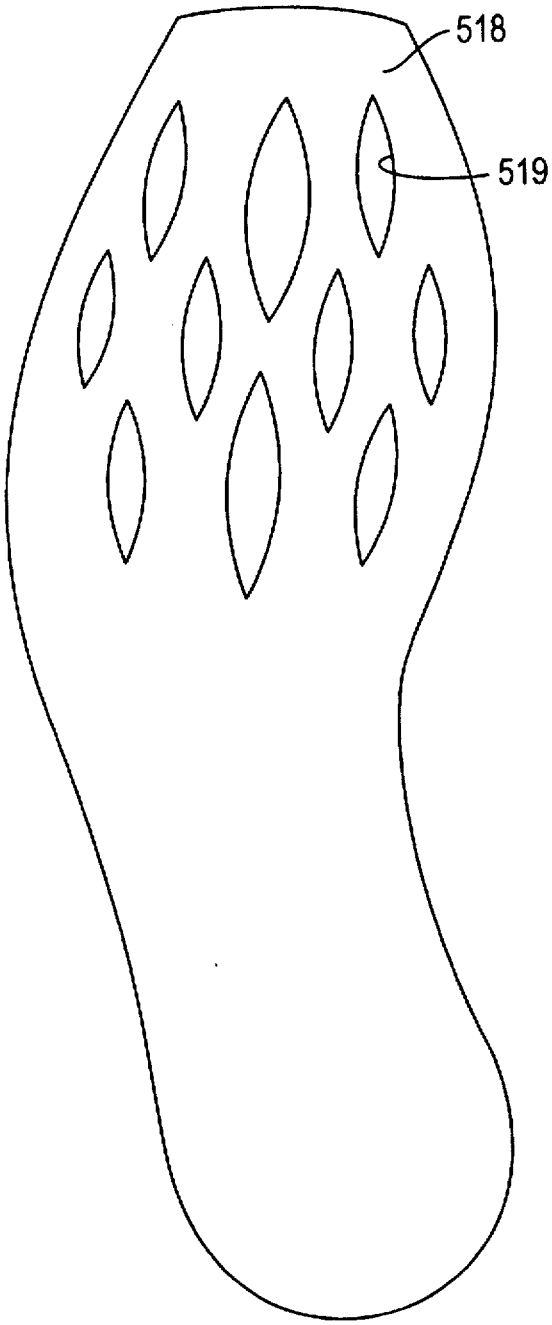
FIG. 27 is a top plan view of a sixth shoe midsole element to be used with any of the preferred embodiments of the present invention.
Figure 28:
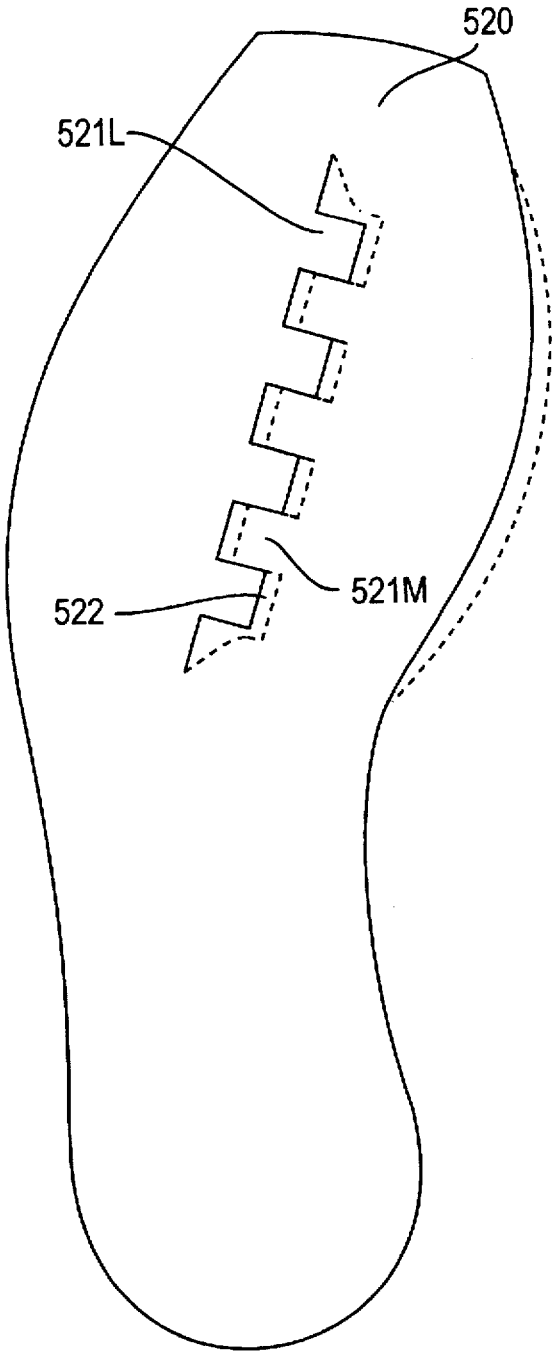
FIG. 28 is a top plan view of a seventh shoe midsole element to be used with any of the preferred embodiments of the present invention.

FIG. 27 illustrates another midsole element 518 with voids 519 which may be left empty or filled with compressible foam, separate foam members or employ a gas filled bladder to provide the necessary material variance. FIG. 28 illustrates yet another midsole element 520 with another type of material variance: interlocking fingers 521L and 521M on the lateral and medial sides respectively disposed in a sawtooth pattern. The solid line illustrate fingers 521L and 521M touching each other which represents the narrowest width of midsole element 520. The broken lines show a midsole element 520 slightly expanded on the medial side which would move fingers 521M away from fingers 521L so that gaps 522 would form. The interlocking fingers would be sized and configured so that any gaps such as gaps 522 which form due to width adjustment do not adversely effect the support across the span of the midsole. Any of the preferred adjustment systems may employ these midsole elements.

Although numerous midsole elements have been illustrated and described, any combination of void patterns with any of the material variance elements such as leaving the void empty, filling with compressible foam, foam members or bladders employed in any of the adjustment systems are contemplated to be within the scope of the invention. Any permutation of the base elements: material variance and an adjustment system allowing for independent adjustment locations is within the scope of the invention. The adjustment locations may be all on one side, or on both sides of the midsole. Although the foregoing description emphasized the forefoot region, the principles of the invention may be applied to any area of the shoe.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

We claim:

1. An adjustment system for fitting a shoe to the foot of a wearer, the shoe having lateral and medial sides, an upper and a sole assembly including a midsole element, portions of the shoe defined by the corresponding foot areas, the sole assembly defining a periphery with lateral and medial aspects, a width and a shape of an outline of the sole assembly, said system comprising:

a material variance provided in the sole assembly to permit adjustment of the width and the outline of the sole assembly; and adjustment means for independently adjusting the width of the sole assembly at a plurality of locations between a nominal central longitudinal axis and the periphery of the sole assembly to thereby adapt the shape of the outline of the sole assembly of the shoe to the foot, said adjustment means comprising a plurality of planar ratchet devices in communication with the midsole element of the sole assembly.

2. The adjustment system of claim 1, wherein said planar ratchet devices are in one-to-one correspondence to said plurality of adjustment locations, said ratchet devices attached to the midsole element, each said ratchet device comprising a first planar toothed surface in opposed relation to a second planar surface having a pawl, said second surface biased so that said pawl releasably engages said toothed surface such that adjustment of each said ratchet device causes a change in the shape of the outline of the sole assembly.

3. The adjustment system of claim 2, wherein said material variance comprises a plurality of flex grooves provided in the sole assembly, said flex grooves configured to allow flexure of said midsole element upon adjustment of any of said ratchet devices to thereby adjust the shape of the outline of the sole assembly and foot supporting surface.

4. The adjustment system of claim 3, wherein said material variance further comprises a gas filled bladder forming part of said midsole element.

5. The adjustment system of claim 2, wherein said plurality of ratchet devices are located on the same side of the sole assembly.

6. The adjustment system of claim 1, wherein said material variance comprises a void in said midsole element.

7. The adjustment system of claim 1, wherein said material variance comprises a void filled with a compressible foam to permit width adjustment of said midsole element.

8. The adjustment system of claim 1, wherein said material variance comprises a void in said midsole element and a gas filled bladder positioned to cooperate therewith to permit width adjustment of said midsole element.

9. The adjustment system of claim 1, wherein one of said plurality of adjustment locations is on the lateral aspect of the sole assembly and another of said plurality of adjustment locations is on the medial aspect of the sole assembly.

10. The adjustment system of claim 1, wherein said plurality of adjustment locations is on the same side of the sole assembly.

11. An article of footwear having lateral and medial sides, said article comprising:

an upper for covering at least a portion of a wearer's foot;

a sole assembly defining a periphery with lateral and medial aspects thereof and defining a width and a shape of an outline of said sole assembly, said sole assembly comprising a midsole element, a material variance provided in said midsole element to permit adjustment of the width and the outline shape, and a plurality of planar ratchet devices each attached to said midsole element, each said ratchet device comprising a first planar toothed surface in opposed relation to a second planar surface having a pawl, said second surface biased so that said pawl releasably engages said toothed surface such that adjustment of each said ratchet device causes a change in the shape of the outline of said sole assembly.

12. The article of footwear of claim 11, wherein one of said ratchet devices is located so as to adjust said sole assembly between said nominal central axis and the medial aspect of said sole assembly, and another of said ratchet devices is located so as to adjust said sole assembly between said nominal central axis and the lateral aspect of said sole assembly.

13. The article of footwear of claim 11, wherein said material variance of said midsole element comprises a void in said midsole element located so as to allow width adjustment of said midsole element.

14. The article of footwear of claim 13, wherein said material variance further comprises a compressible foam placed in said void.

15. The article of footwear of claim 13, wherein said material variance further comprises a gas filled bladder inserted into said midsole element, said bladder configured and positioned to cooperate with said void in allowing width adjustment.

16. The adjustment system of claim 11, wherein said material variance comprises a plurality of flex grooves provided in the sole assembly, said flex grooves configured to allow flexure of said midsole element upon adjustment of any of said ratchet devices to thereby adjust the shape of the outline of the sole assembly and foot supporting surface.

17. An article of footwear having lateral and medial sides, said article comprising:

an upper for covering at least a portion of a wearer's foot;

a sole assembly attached to said upper, said sole assembly comprising a midsole element defining a periphery with lateral and medial aspects, a width and a shape of an outline of the sole assembly, a material variance provided in said midsole element to permit changes in said width and said outline shape, adjustment means for independently adjusting said width of said midsole element at a plurality of locations between a nominal central point and said periphery to thereby adapt said outline shape of said article of footwear to the wearer's foot wherein said material variance comprises a void filled with a compressible foam to permit width adjustment of said midsole element.

18. An article of footwear having lateral and medial sides, said article comprising:

an upper for covering at least a portion of a wearer's foot;

a sole assembly attached to said upper, said sole assembly comprising a midsole element defining a periphery with lateral and medial aspects, a width and a shape of an outline of the sole assembly, a material variance provided in said midsole element to permit changes in said width and said outline shape, adjustment means for independently adjusting said width of said midsole element at a plurality of locations between a nominal central point and said periphery to thereby adapt said outline shape of said article footwear to the wearer's foot wherein said material variance comprises a void in said midsole element and a gas filled bladder positioned to cooperate therewith to permit width adjustment of said midsole element.

* * * * *